US005996251A

United States Patent [19]

LaDuca

[11] Patent Number: 5,996,251

[45] Date of Patent: Dec. 7, 1999

[54] COMBINATION JAZZ DANCING AND CHARACTER/TAP DANCING SHOE

[76] Inventor: Phillip F. LaDuca, 534 Ninth Ave., Apt. 1R, New York, N.Y. 10018

[21] Appl. No.: 09/177,097

[22] Filed: Oct. 22, 1998

[51] Int. Cl.[6] ..... A43B 5/12; A43B 1/10

[52] U.S. Cl. ..... 36/8.3; 36/102

[58] Field of Search ..... 36/8.3, 102, 103, 36/51

[56] References Cited

U.S. PATENT DOCUMENTS

| | | | |
|---|---|---|---|
| 955,337 | 4/1910 | Laylor | 36/51 |
| 2,298,941 | 10/1942 | Herrmann | 36/51 |
| 2,311,996 | 2/1943 | Parker | 36/51 |
| 2,708,321 | 5/1955 | Cathers et al. | 36/8.3 |
| 4,463,506 | 8/1984 | Isackson | 36/8.3 |
| 5,459,946 | 10/1995 | Rayow | 36/8.3 |
| 5,682,685 | 11/1997 | Terlizzi | 36/8.3 |

FOREIGN PATENT DOCUMENTS

| | | | |
|---|---|---|---|
| 2232057 | 12/1990 | United Kingdom | 36/8.3 |

*Primary Examiner*—M. D. Patterson
*Attorney, Agent, or Firm*—Steven Horowitz

[57] ABSTRACT

An unusually versatile dance shoe usable for both jazz dancing as well as tap and character dancing combining the flexibility of a jazz dancing shoe and the support strength of a shoe used for character/tap dancing. This combination shoe has at a minimum a semi-flexible arch made of hard rubber, flexible inserts on the sides of the shoe upper above the arch and a hard leather sole and heel that can accept taps for tap dancing. In the preferred embodiment, for manufacturing purposes, the rubber arch is part of a continuous rubber layer that extends front and back over the leather heel and sole so that it is the whole length and width of the shoe. Consequently, the dancer has the ability to achieve the aesthetic result from dancing flexibly such as by standing fully on pointe on the tip of the shoe or standing three-quarters on pointe while simultaneously having the support and strength necessary to tap dance and perform character dance steps such as stomping, kicking, scuffing, slamming and clicking. Versatility allows the optional attachment of taps and can therefore be used with or without taps. When taps are used, an extra rubber equalizing layer can be added if desired.

6 Claims, 4 Drawing Sheets

FIG. 2
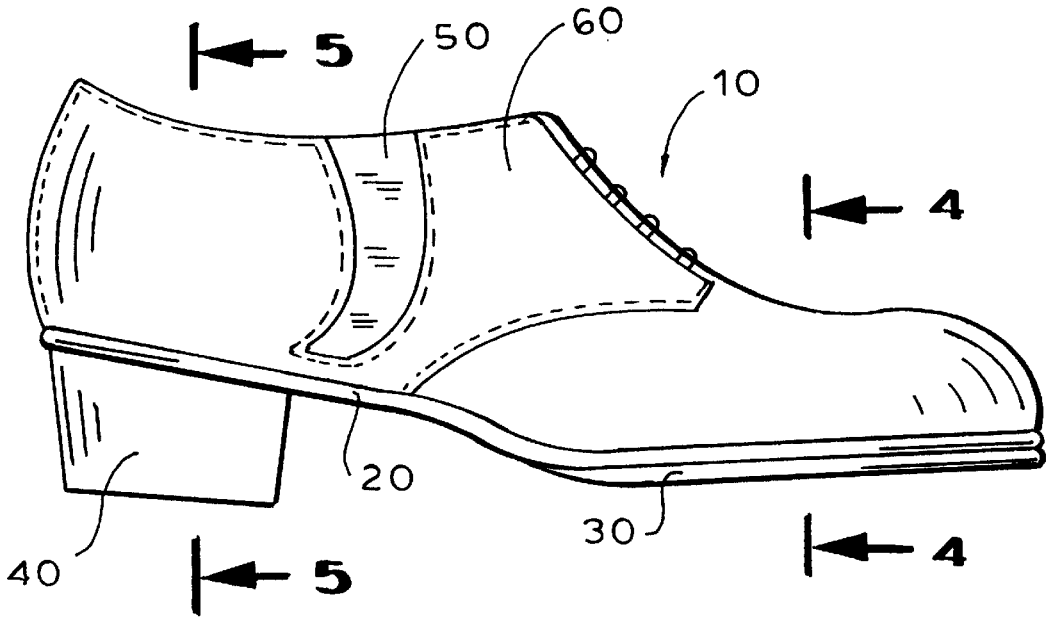
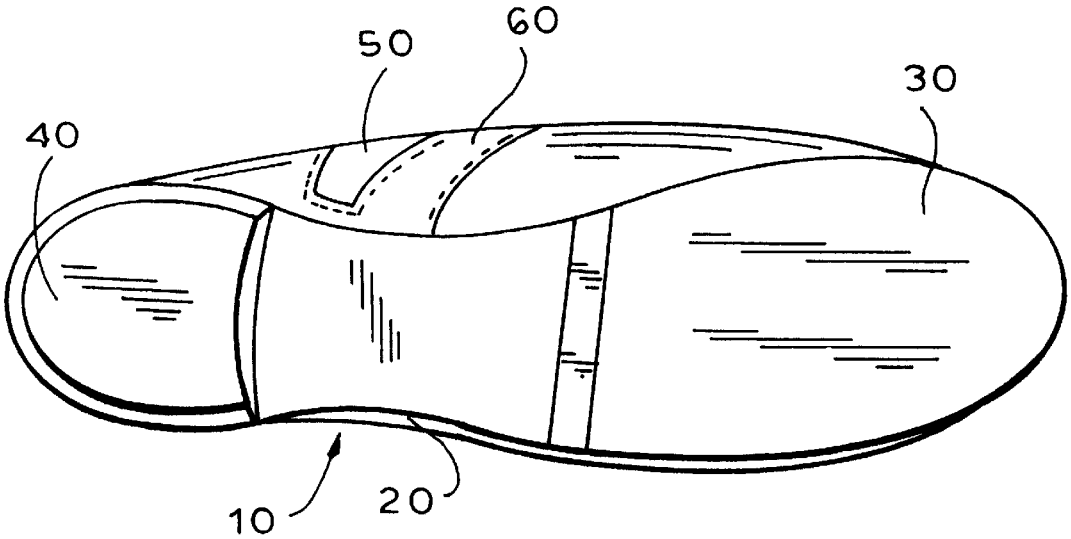
FIG. 3

FIG. 6
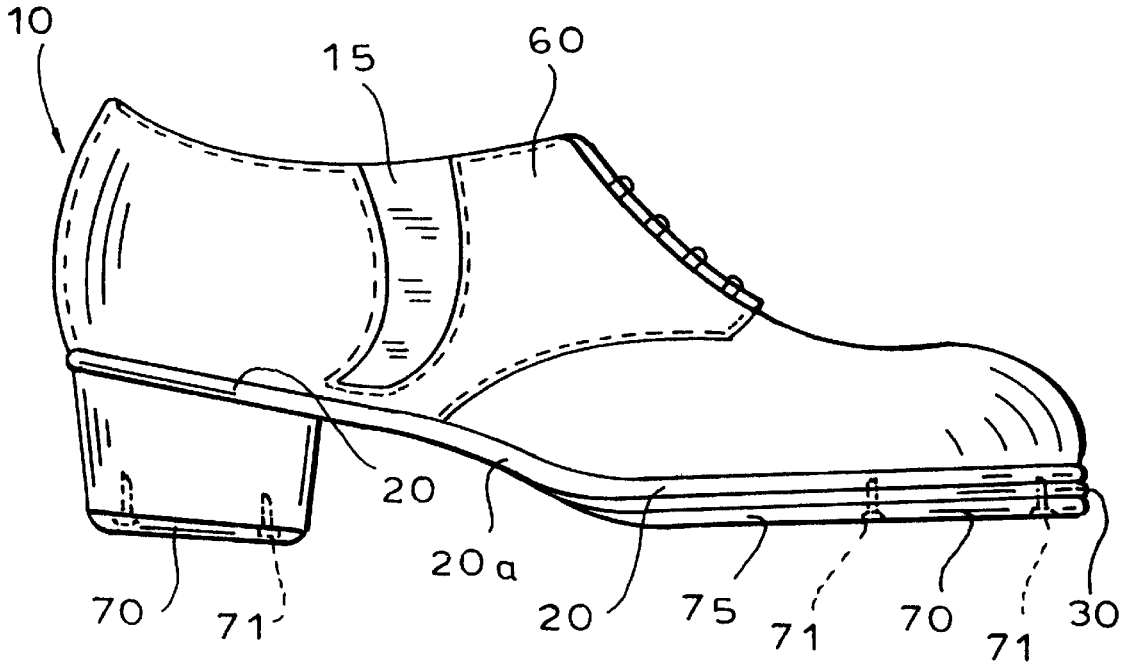
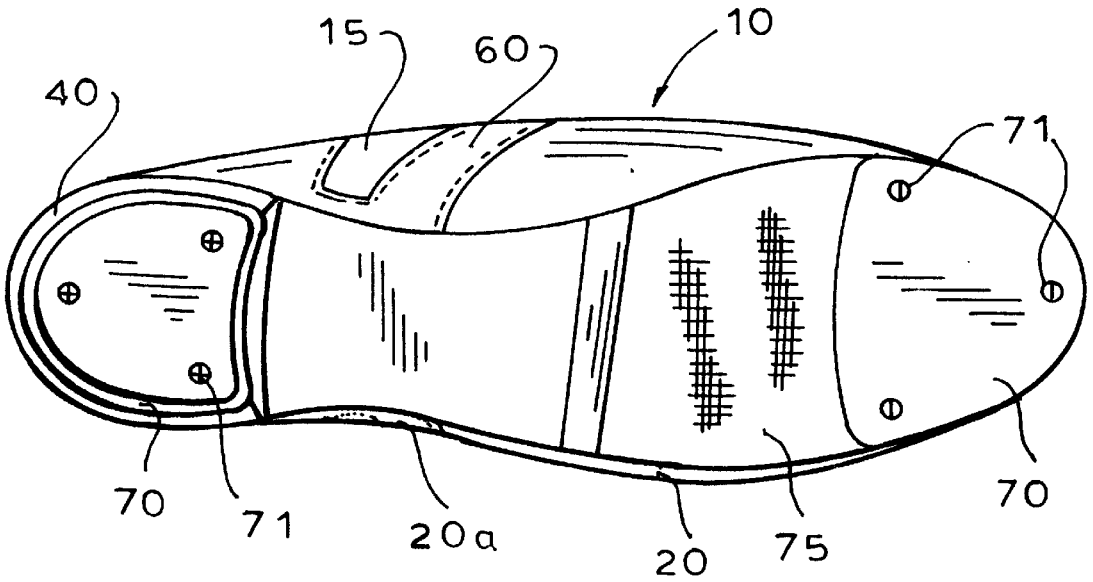
FIG. 7

COMBINATION JAZZ DANCING AND CHARACTER/TAP DANCING SHOE

The present invention relates to footwear designed to have the versatility to be used in diverse dance styles, in particular in jazz dancing and character or tap dancing.

Jazz dancing is a flexible free form of dancing that requires soft, pliable manipulation of the feet and toes including the dancer pointing the foot for aesthetic effect. Ballet, while it is a rigid stylized dance form, also involves soft, pliable manipulation of the foot for aesthetic effect.

Character dancing or folk dancing, in contrast to jazz dancing and ballet, involves energetic steps such as stomping, kicking, scuffing, slamming and clicking. One can imagine such steps as part of energetic movements in typical well known Broadway musical plays such as Chorus Line or West Side Story. Tap dancing, which involves tapping steps by dance shoes containing taps, may be thought of as a kind of American folk dancing.

As a result of these differences in dance styles, there are corresponding differences in the footwear needed by dancers that are dancing in these styles. For example, the dance shoes needed for jazz dancing have soft soles and soft shoe uppers in order to provide sufficient flexibility to the dancer's foot. Ballet dance slippers, worn by male or female dancers to go three quarters on pointe (called "three quarter releve"), are soft as well while ballet point dance shoes are worn by female dancers to go fully on pointe (called "on toe") and have a stiff shoe support box at the front of the shoe to allow the dancer to go on pointe but the remainder of the shoe is very soft and flexible. There are also jazz dancing shoes that have reinforced toe sections that permit the dancer to stand on pointe.

In contrast to the footwear used by jazz dancers, the existing dance shoes used for character dancing and for tap dancing have hard leather soles, hard leather heels and firm, strong shoe uppers so that the dance shoe can provide the support and strength needed to perform energetic dance steps used in character dancing like stomping, kicking, scuffing, slamming and clicking and the tap steps used in tap dancing. Dance shoes used by tap dancers and by character dancers are not designed to allow the dancer to comfortably stand on pointe and in fact if a dancer wearing such shoes did stand on pointe that dancer would be placing a great strain on the dancer's foot. The result would be awkward and possibly harmful over the long run. It would also be awkward and difficult for a dancer wearing dance shoes used in character or tap dancing to dance jazz dancing steps, which requires pliable manipulation of the feet and toes.

Furthermore, if one were to put taps on a jazz dance shoe to try to use it for tap dancing, it would be harmful to the foot because a jazz dance shoe is too soft and flexible and would not provide adequate support to receive a tap screw.

Notwithstanding the differences in styles between jazz dancing on the one hand and character or tap dancing on the other hand, it has become very fashionable today for tap dancers to stand on their toes. Accordingly, there have been companies that have marketed and sold slightly modified jazz dance shoes in that the shoes have the standard soft soles and shoe uppers for jazz dance shoes but with harder heels that can accept taps. These shoes, however, are still ineffective in allowing a jazz dancer to comfortably and easily standing on pointe. Nor are these shoes able to provide the strength and support needed for character dance steps such as stomping, kicking, scuffing, slamming and clicking.

It is also known that certain character dance shoes have been used by dancers performing specifically in musical theater and dance concerts for both character dancing and jazz dancing, although such shoes are really not suitable for both styles.

Accordingly, there has been for a long time a need for dance shoes that can provide the support and strength needed for tap dancing and for character dance steps and somehow also provide the flexibility needed for jazz dancing steps.

Although shoes that combine features of more than one style of dancing are known in the art, they do not achieve this result. For example, U.S. Pat. No. 5,111,597 to Hansen et al. discloses a dance shoe having a toe end and a heel end with a flexible outer sole for jazz dancing made of rubber or leather and a toe support made of a relatively rigid material. The Hansen shoe cannot support taps or be used for tap dancing because the sole is too thin to accept tap screws and because the sole is not strong enough to accept tap plates. In fact, the shoe upper of the Hansen shoe is too soft and flexible to support tap steps and even too soft and flexible to support character dance steps like stomping, kicking, scuffing, slamming and clicking. The Hansen shoe is really designed for ballet dancers who also dance jazz. Furthermore, if one contemplated thickening the toe support on the Hansen shoe in order to allow it accept taps, this would distort the shoe and would make it very uncomfortable for the dancer to stand on pointe. In addition, it also appears that male dancers would not generally wear the Hansen dance shoe since they go up fully on pointe, e.g. on toe, only rarely.

U.S. Pat. No. 5,682,685 to Terlizzi is a dance shoe having a stiff sole split between the front and rear to enable the dancer to stand on pointe. The Terlizzi shoe, however, is not designed for tap dancing. The front and rear soles are not capable of accepting taps. Moreover, the Terlizzi shoe does not support the arch the way a tap dancing shoe does and extensive use as a tap dancing shoe may cause discomfort. The area between the front and rear soles in the Terlizzi shoe provides no real strength and support.

Accordingly, there continues to be a need for shoes that are designed for and that can offer the support and strength needed for tap dancing and character dancing and the flexibility needed for jazz dancing.

In brief summary, the dance shoe of the present invention is designed specifically both for jazz dancing and for tap character dancing. To this aim, the dance shoe of the present invention is able to combine the flexibility of a jazz dancing shoe with the support and strength of a shoe used for character and tap dancing. This result is achieved by carefully controlling and targeting to specific locations the tensile strength and hardness of the elements of the shoe. Specifically, this combination shoe has a semi-flexible arch or shank that is made of a hard rubber that is hard enough to provide strength and support but flexible enough to permit the dancer to stand on pointe and perform jazz steps. This rubber arch forms can, preferably for manufacturing purpose, form part of a rubber layer extending the length and width of the shoe. A flexible insert on the sides of the shoe upper above the arch is also provided as well as a hard leather sole and a hard leather heel joined to and located below the rubber layer. The heel and sole are hard enough and thick enough to accept and hold taps used in tap dancing. Alternatively, (i) the rubber layer of which the rubber arch is a part can be extended to above the front sole and not above the heel, or vice versa or (ii) the rubber arch can be the only rubber and the heel and sole are joined directly to the bottom of the shoe body.

The following objects and advantages of the present invention are:

(a) to provide a dancer's shoe having the flexibility required for jazz dancing steps as well as the support and strength required for tap dancing and "character" dancing steps such as stomping, kicking, scuffing, slamming and clicking, (b) to provide a dance shoe that targets the hardness and softness for each part of the shoe so as to achieve both flexibility and strength, (c) to provide a dancer's shoe that permits the dancer to stand on pointe completely or three quarters very easily and very comfortably with or without taps used for tap dancing, (d) to provide a dancer's shoe that has a semi-flexible arch or shank that is made of a hard rubber that is hard enough to provide strength and support but flexible enough to permit the dancer to stand on pointe and perform jazz steps, (e) to provide a dancer's shoe that has a semi-flexible arch, a hard leather heel, a hard leather sole and elastic inserts sewn into the sides of the shoe uppers, preferably above the arch area, (f) to provide a dance shoe that is made so that it can be used with or without taps and (g) to provide a dance shoe that is suitable to be worn by both male and female dancers.

BRIEF DESCRIPTION OF THE DRAWINGS

FIG. 2 is a side elevation view of the shoe of the present invention.

FIG. 3 is a bottom plan view of the show of the present invention.

FIG. 6 is a side elevation view of the shoe of the present invention with taps and an equalizer added.

FIG. 7 is a bottom plan view of the shoe of the present invention with taps and an equalizer.

DETAILED DESCRIPTION OF THE DRAWINGS

Figure 1:
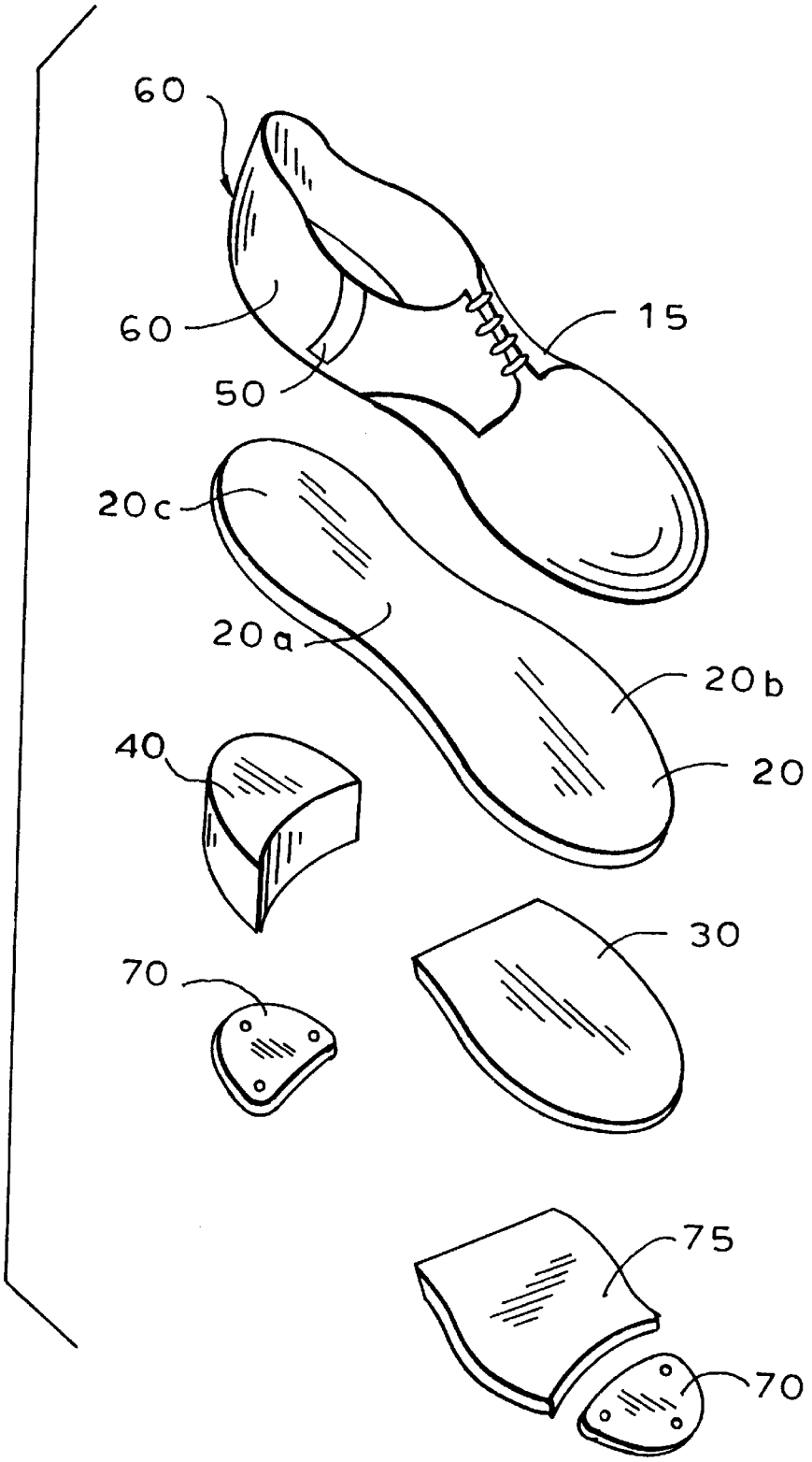
FIG. 1 is an exploded perspective view of the elements of a shoe of the present invention.

In order to better understand the present invention in conjunction with the drawings of FIGS. 1–8, the dance shoe of the present invention is assigned reference numeral 10 and its elements are described and assigned the reference numerals identified below. FIG. 1 depicts the unassembled elements of shoe 10. Shoe body 15 includes shoe upper 60 and shoe bottom. Shoe upper 60 is itself made of standard flexible leather but it includes flexible elastic inserts 50 sewn into each side of the shoe upper 60 preferably above the area of the arch 20*a*. Also shown separately is continuous rubber layer 20 extending the width and length of the shoe 10. Hard heel 40 and hard front sole 30 are also shown below rubber layer 20. Finally, metal taps 70 and rubber equalizer 75 are shown.

FIG. 2 is a side elevation view of dance shoe 10 showing one side 62 of shoe upper 60. One of the two flexible inserts 50 is located on each side 62 of the shoe upper 60. Each of flexible inserts 50 is made of an elastic stretch material. The inserts 50 typically run from the top 62*a* of each side 62 of the shoe upper 60 and to be effective in enhancing flexibility should cover most of the height of the side 62 of the shoe upper 60.

Just below shoe upper 60 is a layer 20 of hard rubber 20 that at a minimum comprises arch 20*a* and preferably is a continuous layer that runs the length of the shoe 10. At a minimum at the location of the arch 20*a,* this layer 20 of rubber is semi-flexible—that is, it is hard enough or has sufficient tensile strength to provide strength and support while at the same time it is flexible enough to permit the dancer to stand on pointe and perform jazz steps.

While the preferred tensile strength of arch 20*a* is approximately 6 newtons per square millimeter, "newtons per square millimeter" being denoted herein as "N/mmq", it is believed that the tensile strength of arch 20*a* can vary from between approximately 5 newtons per square millimeter or 5 N/mmq. to approximately 8 or 9 N/mmq and still maintain the advantages of the present invention.

As depicted in FIGS. 1–8, this semi-flexible layer 20 is a continuous layer of hard rubber that runs the width and length of the shoe 10. Semi-flexible layer 20 can be thought of as being composed of arch 20*a,* front rubber portion 20*b* and rear rubber portion 20*c.* Front and rear rubber portion 20*b,* 20*c* are situated above and are joined to the leather sole 30 and leather heel 40, respectively.

Figure 8:
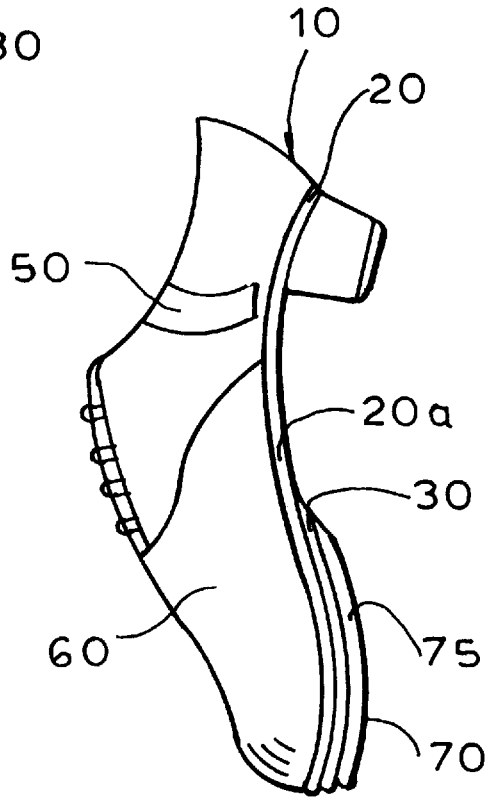
FIG. 8 is a side elevation view of the shoe of the present invention with the dancer's foot on pointe.

An important part of the present invention is the hard yet semi-flexible nature of the part of hard rubber 20 that forms the arch 20*a* or shank 20*a* of the shoe 10. This is one of the features which in combination provides the flexibility needed by the dancer to stand on pointe, as seen in FIG. 8, yet is hard enough to allow the dancer the strength and support to perform such dance steps as stomping, kicking, cuffing, slamming, clicking as part of character dancing as well as tap dancing.

Another feature of the present invention that forms part of the combination of features needed to achieve the versatile dance shoe of the present invention is the hard sole 30 in the front of the shoe 10 and the hard heel 40 in the rear of the shoe. Both front sole 30 and heel 40 are made of hard leather or wood and are attached below the front and rear portions of rubber layer 20. Hard sole 30 and hard heel 40 are not flexible and can accept taps 70 and retain them during vigorous dancing steps. It should be noted also that leather or wood heels or soles are used in the present invention to accept the tap because they do so more effectively than other materials, for example, rubber or plastic, in that the right resonance is achieved when the tap is tapped. Dance shoe 10 can be used with or without taps 70. Taps 70 are attached through to forward portion of the front sole 30 and to heel 40 using standard means such as screws 71.

In certain embodiments rubber layer 20 does not run the length and width of the shoe 10 but at a minimum it must consists of semi-flexible arch support 20*a* to provide the desired proportion of flexibility and support. If layer 20 consists only of arch support 20*a,* heel 40 and sole 30 join directly to the bottom front and the bottom rear of the body of the shoe 10. For manufacturing purposes the rubber layer 20 may extend the length and width of the shoe 10. Or, for manufacturing purposes, rubber layer 20 may consist of arch 20*a* and front rubber portion 20*b* in which case it would comprise arch 20*a* and would extend above front sole 30 but not the heel 40. In that case, heel 40 would be joined directly to the bottom rear of the shoe body 15 whereas the sole 30 would be joined to the front rubber portion 20*b* of rubber layer 20.

Figure 4:
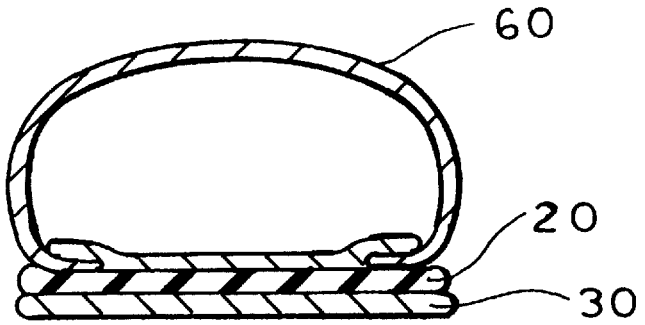
FIG. 4 is a cross-sectional view of the shoe of the present invention taken along line 4—4 of FIG. 2.
Figure 5:
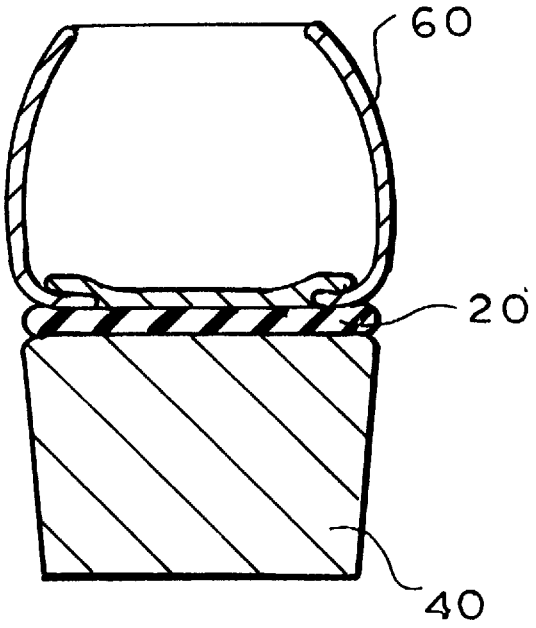
FIG. 5 is a cross-sectional view of the shoe of the present invention taken along line 5—5 of FIG. 2.

FIG. 4 shows a cross-sectional view of dance shoe 10 in the front of the shoe 10. Rubber layer 20 is between front sole 30 and shoe body 15. FIG. 5 shows a cross-sectional view of the rear of the dance shoe 10 where rubber layer 20 is sandwiched between hard heel 40 and shoe body 15.

FIGS. 6 and 7 depict the side and bottom views of the dance shoe 10 of the present invention with taps 70 attached to the front and rear of the shoe 10.

As seen from FIGS. 7, 8, when taps are used, a rubber equalizer 75 can be added if desired adjacent the front tap 70 in order to level the bottom of the shoe 10. The front tap 70 is attached to a forward portion of the front sole 30 and the equalizer is attached to a remaining portion of the front sole 30.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A dancer's shoe that has the flexibility required for jazz dancing and for standing on pointe with or without taps and the support strength required for tap and character dancing including tapping, stomping, clicking, scuffing, kicking and slamming, comprising:

a semi-flexible arch support made of hard rubber that has a tensile strength of between approximately 5 and approximately 9 N/mmq, a shoe body including a flexible shoe upper shaped for receiving the dancer's foot, said shoe upper including left and right sides that have an elastic insert above the arch support, a hard front sole made of leather having means for receiving and retaining during dancing a metal tap affixed to a forward portion of the front sole and a rubber equalizer affixed to a remaining portion of the front sole, a hard leather heel having means for receiving and retaining during dancing a metal tap affixed thereto, wherein said semi-flexible arch support is part of a continuous layer of hard rubber that includes the arch support and a front rubber portion of said continuous layer that spans the length and width of the hard front sole and is located above and joined to the hard front sole.

2. The shoe of claim 1, wherein each elastic insert runs from a top of each side of the shoe upper and extends until just above the arch support.

3. A dancer's shoe that has the flexibility required for jazz dancing and for standing on pointe with or without taps and the support strength required for tap and character dancing including tapping, stomping, clicking, scuffing, kicking and slamming, comprising:

a semi-flexible arch support made of hard rubber that has a tensile strength of between approximately 5 N·mmq and approximately 9 N/mmq, a shoe body including a flexible shoe upper shaped for receiving the dancer's foot, said shoe upper including left and right sides that have an elastic insert above the arch support, a hard front sole made of leather having means for receiving and retaining during dancing a metal tap affixed to a forward portion of the front sole and a rubber equalizer affixed to a remaining portion of the front sole, a hard leather heel having means for receiving and retaining during dancing a metal tap affixed thereto, said semi-flexible arch support located between the front sole and the heel, wherein the semi-flexible arch support is part of a continuous layer of hard rubber that runs the width and length of the shoe and whose front rubber portion and rear rubber portion are situated above and joined to the leather sole and leather heel, respectively.

4. The dancer's shoe of claim 3, wherein the elastic insert runs from a top of each side of the shoe upper and extends until just above the arch support.

5. A dancer's shoe that has the flexibility required for jazz dancing and for standing on pointe with or without taps and the support strength required for tap and character dancing including, tapping, stomping, clicking, scuffing, kicking and slamming, comprising:

a semi-flexible arch support made of hard rubber that has a tensile strength of between approximately 5 N/mmq and approximately 9 N/mmq, a shoe body including a flexible shoe upper shaped for receiving the dancer's foot, said shoe upper including left and right sides that have an elastic insert above the arch support, a hard front sole made of leather located below and joined to the shoe body having means for receiving and retaining during dancing a metal tap affixed to a forward portion of the front sole and a rubber equalizer affixed to a remaining portion of the front sole, a hard leather heel located below and joined to the shoe body having means for receiving and retaining during dancing a metal tap affixed thereto, said semi-flexible arch support located between the front sole and the heel, wherein the semi-flexible arch support is joined to the leather sole and leather heel.

6. The dancer's shoe of claim 5, wherein the elastic insert runs from a top of each side of the shoe upper and extends until just above the arch support.

* * * * *